US006095764A

United States Patent [19]

Shibamoto et al.

[11] Patent Number: 6,095,764

[45] Date of Patent: Aug. 1, 2000

[54] REVERSE ROTATION PROTECTION FOR A SCROLL COMPRESSOR USING A VALVE MEANS

[75] Inventors: Yoshitaka Shibamoto; Mikio Kajiwara; Keiji Yoshimura; Shuusaku Ueda, all of Osaka, Japan

[73] Assignee: Daikin Industries, Ltd., Osaka, Japan

[21] Appl. No.: 09/000,160

[22] PCT Filed: May 27, 1997

[86] PCT No.: PCT/JP97/01799

§ 371 Date: Jan. 28, 1998

§ 102(e) Date: Jan. 28, 1998

[87] PCT Pub. No.: WO97/45642

PCT Pub. Date: Dec. 4, 1997

[30] Foreign Application Priority Data

May 28, 1996 [JP] Japan ..... 8-133818

[51] Int. Cl.[7] ..... F04B 49/00

[52] U.S. Cl. ..... 417/310; 417/440; 417/410.5

[58] Field of Search ..... 417/310, 440, 417/410.5

[56] References Cited

U.S. PATENT DOCUMENTS 5,452,989 9/1995 Rood et al. ..... 417/310

FOREIGN PATENT DOCUMENTS 0 479 421 4/1992 European Pat. Off. ..... 417/310

0 655 555 5/1995 European Pat. Off. ..... 417/310

2-125986 5/1990 Japan .

4-241702 8/1992 Japan .

1-318778 12/1999 Japan .

*Primary Examiner*—Timothy S. Thorpe

*Assistant Examiner*—Cheryl J. Tyler

*Attorney, Agent, or Firm*—Nixon Peabody LLP; Donald R. Studebaker

[57] ABSTRACT

A scroll compressor (A) includes a barrier wall (25) which divides the internal cavity of a casing (1) into a discharge chamber (22) and a suction chamber (23) and has a discharge opening (25*b*) for providing the communication of the compartments (22) and (23), a check valve (27) operable to prevent a flow of gas from the discharge chamber (22) into the suction chamber (23), and a scroll compression mechanism (3) which is provided in the suction chamber (23), which a space (36) left between the mechanism (3) and the barrier wall (25), for discharging compressed gas into the space (36). In addition, a valve (31) is provided in the space (36) which has a seal member (32) operable to interrupt the communication of an inner compartment (34) with an outer compartment (35) of the space (36) during the correct operation period while on the other hand providing the communication during the reverse operation period. Without suffering a drop in performance during the correct operation period, frictional heat occurring at the forward end surfaces of involute bodies (10*b*) and (11*b*) of fixed and moving scrolls (10) and (11) is positively removed to outside the scroll compression mechanism (3), thereby preventing these end surfaces from undergoing seizing.

12 Claims, 9 Drawing Sheets

REVERSE ROTATION PROTECTION FOR A SCROLL COMPRESSOR USING A VALVE MEANS

BACKGROUND OF THE INVENTION

1. Technical Field

This invention generally relates to a scroll compressor with a scroll compression mechanism made up of a fixed scroll and a moving scroll and more specifically to technology to prevent damage to the scroll compression mechanism due to opposite rotation of the moving scroll to the correct rotation direction.

2. Background Art

A typical scroll compressor of this type has in a casing a scroll compression mechanism comprising two different scrolls, namely a moving scroll rotatably driven by a motor and a fixed scroll secured to the casing. The moving scroll has a panel board from which an involute body projects. On the other hand, the fixed scroll has a panel board disposed so as to face the panel board of the moving scroll. Disposed on the panel board of the fixed scroll is an involute body which engages with the involute body of the moving scroll in order that a compression chamber may be defined therebetween. Approximately centrally formed in the panel board of the fixed scroll is a discharge port through which gas compressed in a compression chamber between the two involute bodies is discharged towards the back of the fixed scroll. A portion of the casing on the side of the back of the fixed scroll acts as a high-pressure discharge chamber, in other words, the casing is divided into two portions, namely the high-pressure discharge chamber and a low-pressure suction chamber. If such division of the casing internal cavity is made by the fixed scroll per se, the fixed scroll is likely to undergo bending due to differential in pressure between the discharge chamber and the suction chamber. As a result, the compressor falls off in performance. With a view to providing a solution to such a problem, Japanese Patent Application Laying Open Gazette No. 2-125986 has offered a proposal in which a barrier wall (partition) for providing a division into a discharge chamber and a suction chamber is disposed on the fixed scroll rear side.

Japanese Patent Application Laying Open Gazette No. 4-241702 shows a scroll compressor. A discharge opening is formed in the barrier wall for introducing gas, discharged from the discharge port of the fixed scroll, to the discharge chamber. A check valve is disposed at an opening portion of the discharge opening on the side of the discharge chamber, in order to prevent reverse flow of the gas from the discharge chamber into the suction chamber. In accordance with this prior art scroll compressor, a seal member is provided between the fixed scroll and the barrier wall in order to provide a hermetical seal between an inner compartment including the discharge port and the discharge opening and an outer compartment on the peripheral side of a space defined between the fixed scroll and the barrier wall.

In such a scroll compressor, when the moving scroll is normally operated, that is, when the moving scroll is operated in the correct rotation direction, gas flows in the scroll compression mechanism. Frictional heat, caused by contact of the forward end surfaces of the involute bodies of the fixed and moving scrolls with their respectively facing panel boards, is released to outside the scroll compression mechanism because of such a gas flow, therefore producing no problems.

If the moving scroll is opposition operated or operated in a rotation direction opposite to the correct rotation direction for some reason such as inaccurate power wiring of the drive motor, then the check valve is closed. The discharge port pressure falls below that of the suction and discharge chambers, and a vacuum is finally created. Because of this, gas stagnates and ceases to flow and frictional heat becomes close in the scroll compression mechanism. Both of the involute bodies undergo thermal expansion due to the fictional heat, as a result of which the forward end surfaces of the involute bodies are abnormally pressed against their respectively facing panel boards. Much greater frictional heat is produced, therefore causing seizing in the forward end surfaces of the involute bodies immediately after the moving scroll starts rotating. There is room for improvement on the prior art technology.

Japanese Patent Application Laying Open Gazette No. 1-318778 offers a proposal. A relief passage is formed in the fixed scroll for providing connection between the periphery of the moving and fixed scrolls and the discharge port, and a relief valve is disposed which is operable to close the relief passage during the correct operation period while on the other hand opening the relief passage during the reverse operation period. During the reverse operation period, gas is circulated, through the relief passage, between the discharge and suction sides of the scroll compression mechanism, with a view to preventing damage to the involute bodies due to seizing. In this prior art technique, gas is circulated as follows. The gas is first forced to flow in a compression chamber of the scroll compression mechanism from the centrally located discharge port toward the periphery in a direction opposite to the direction of the correct operation period. Thereafter, the gas is forced to return to the discharge port by way of the relief passage. In this way, frictional heat generated is removed to outside the scroll compression mechanism.

In accordance with the technology proposed in JP Pat. Appln. Laying Open Gazette No. 1-318778, the involute body forward end surface will not undergo seizing as soon as the moving scroll starts rotating; however, since the relief passage is formed within the fixed scroll this becomes a bar to sufficient removal of frictional heat to outside the scroll compression mechanism. Eventually, the frictional heat causes damage to the involute bodies after an elapse of a certain period of time. This prior art technique may be problematic.

In addition to the above-noted problem, even when the relief passage is closed by the relief valve during the correct operation period, compressed gas will go into the relief passage. The fixed scroll will become deformed and the loss of heating will occur. Further, due to reverse flow of the gas that entered the relief passage, the gas reexpands resulting in a drop in the compressor performance.

Bearing in mind the foregoing problems with prior art techniques, the present invention was made. Accordingly, a general object of this invention is to provide technology having the ability to effectively prevent the occurrence of involute body forward end surface seizing. This object is achieved by improvements in scroll compressors with a barrier wall having a discharge opening and a check valve disposed on the side of a discharge chamber of a scroll compression mechanism, more specifically, by improvements in the construction of seal members to be disposed between the barrier wall and the fixed scroll, whereby frictional heat, occurring in the involute body forward end surfaces during the reverse operation period, is positively removed to outside the scroll compression mechanism, without a drop in the compressor performance during the correct operation period.

DISCLOSURE OF THE PRESENT INVENTION

In order to achieve the foregoing object, the present invention includes a valve means which is provided in a space defined between a scroll compression mechanism and a barrier wall. The valve means is operable to interrupt communication between an inner compartment and an outer compartment of the space during the correct operation period. On the other hand, during the reverse operation period, the valve means is operable to provide the communication.

Reference is now made to FIGS. 1 and 2 for describing the present invention. The present invention provides a scroll compressor comprising:

a barrier wall (25) provided in a casing (1) with an internal cavity portion in order that said internal cavity portion may be divided into a discharge chamber (22) and a suction chamber (23) and having a discharge opening (25*b*), for providing communication between said discharge chamber (22) and said suction chamber (23);

a check valve (27) for allowing gas to flow from said suction chamber (23) into said discharge chamber (22) through said discharge opening (25*b*) while preventing a reverse flow of said gas from said discharge chamber (22) into said suction chamber (23); and a scroll compression mechanism (3) disposed in said suction chamber (23) with a space (36) defined between said scroll compression mechanism (3) and said barrier wall (25) and fixed to said casing (1), said scroll compression mechanism (3) including (a) a fixed scroll (10) which has a panel board (10*a*) from which an involute body (10*b*) projects and (b) a moving scroll (11) which has a panel board (11*a*) from which an involute body (11*b*) projects in such a way as to engage with said involute body (10*b*) of said fixed scroll (10), wherein, by virtue of rotation of said moving scroll (11), gas is introduced into a compression chamber (14) between said fixed scroll (10) and said moving scroll (11) from the periphery of both said involute bodies (10*b*, 11*b*) for compression therein and thereafter is discharged to said space (36) through a discharge port (10*c*);

said scroll compressor further comprising:

valve means (31);

said valve means (31) being disposed in order that said space (36) may be divided into an inner compartment (34) in communication with said discharge port (10*c*) side of said scroll compression mechanism (3) and an outer compartment (35) in communication with each said involute body (10*b*, 11*b*) outer peripheral side;

said valve means (31) being operable to interrupt the communication of said inner compartment (34) with said outer compartment (35) during the correct operation period of said moving scroll (11) in which said moving scroll (11) is operated in a forward rotation direction; and said valve means (31) being operable to provide the communication of said inner compartment (34) with said outer compartment (35) during the reverse operation period of said moving scroll (11) in which said moving scroll (11) is operated in the reverse rotation direction.

In accordance with the above-described structure, during the scroll compressor correct operation period, the inner compartment (34) is filled with high-pressure gas discharged from the discharge port (10*c*) of the fixed scroll (10), while on the other hand the outer compartment (35) is filled with low-pressure gas on the side of the suction chamber (23). At this time, the communication of the inner compartment (34) with the outer compartment (35) is interrupted by the valve means (31), whereby the high-pressure gas in the inner compartment (34) is discharged, passing through the discharge opening (25*d*) of the barrier wall (25) and the check valve (27), to the discharge chamber (22). In other words, the compressor operates normally.

Since the fixed scroll (10) is not provided with anything extra such as an escape passage, this prevents the deformation of the fixed scroll (10), the loss of heating, and the reexpansion of gas from occurring during the correct operation period, therefore making improvement of the compressor performance.

On the other hand, the moving scroll (11) is operated in the reverse rotation direction during the reverse operation period, at which time the scroll compression mechanism (3) tries to take in gas from the discharge port (10*c*), resulting in placing the check valve (27) in the closed position. The pressure of the inner compartment (34) falls below that of the suction chamber (23), i.e., the outer compartment (35). At this time, if the communication between the compartments (34) and (35) remains interrupted by the valve means (31), then there is no flow of gas between the compartments (34) and (35). However, the valve means (31) opens in order that the inner compartment (34) and the outer compartment (35) may communicate with each other. As a result, the gas circulates as follows. The gas first enters the scroll compression mechanism (3) from the inner compartment (34) by way of the discharge port (10*c*). In the scroll compression mechanism (3), the gas flows in a direction opposite to the direction of the correct operation period and thereafter the gas flows to outside the mechanism (3). Then, the gas moves around the outer periphery of the mechanism (3), passes through the outer compartment (35) and the valve means (31), and finally returns to the inner compartment (34). Frictional heat, occurring in the forward end surfaces of the involute bodies (10*b*) and (11*b*), is removed by the aforesaid gas circulation to outside the scroll compression mechanism (3). The gas circulates throughout the outer periphery of the fixed and moving scrolls (10) and (11). Radiation of the frictional heat is performed sufficiently, thereby preventing the forward end surfaces of the involute bodies (10*b*) and (11*b*) from undergoing seizing even when the compressor (A) is opposition operated for a long period of time.

It is possible in the aforesaid scroll compressor that:

a concave recess (25*a*) is provided in a surface of said barrier wall (25) on the side of said suction chamber (23), said concave recess (25*a*) having at its bottom wall said discharge opening (25*b*);

a boss (10*d*) is provided on said fixed scroll (10) wherein said boss (10*d*) is play-fitted into said concave recess (25*a*) of said barrier wall (25) in such a way as to define a clearance which partly forms said space (36) and has said discharge port (10*c*); and said valve means (31) includes:

a valve seat (10*f*) formed at said boss (10*d*) outer peripheral surface; and a seal member (32);

said seal member (32) being hermetically and slidably fitted into said concave recess (25*a*) of said barrier wall (25) in order that a clearance, defined between said boss (10*d*) outer peripheral surface and said concave recess (25*a*) inner peripheral surface, is divided into said inner compartment (34) and said outer compartment (35), with a clearance (40) left between said seal member (32) inner peripheral surface and said boss (10*d*) outer peripheral surface;

said seal member (32) being operable to sit on said valve seat (10*f*) when the pressure of said inner compartment (34) exceeds that of said outer compartment (35) thereby interrupting the communication of said inner compartment (34) with said outer compartment (35); and said seal member (32) being operable to move away from said valve seat (10*f*) when the pressure of said outer compartment (35) exceeds that of said inner compartment (34) thereby providing the communication of said inner compartment (34) with said outer compartment (35).

As a result of such arrangement, during the correct operation period of the scroll compressor mechanism (3), the inner compartment (34) is filled with high-pressure gas while on the other hand the outer compartment (35) is filled with low-pressure gas. The pressure of the inner compartment (34) exceeds that of the outer compartment (35), wherein the seal member (32) makes a shift towards the outer compartment (35) to sit on the valve seat (10*f*). At this time, although the clearance (40) between the seal member (32) inner peripheral surface and the boss (10*d*) outer peripheral surface comes to communicate with the inner compartment (34), the communication with the outer compartment (35) is interrupted. As a result, the communication of the inner compartment (34) with the outer compartment (35) is broken.

On the other hand, during the reverse operation period, the pressure of the inner compartment (34) falls below that of the outer compartment (35) and the seal member (32) travels towards the inner compartment (34), i.e., in the direction away from the valve seat (10*f*). As a result, the clearance (40) communicates with both of the inner compartment (34) and the outer compartment (35), therefore creating the situation in which the compartments (34) and (35) communicate with each other. This achieves the valve means (31) which is simple, inexpensive, and easy to form. It is possible that:

a ring groove (10*e*) is provided in said boss (10*d*) outer peripheral surface of said fixed scroll (10) for external fitting of said seal member (32) thereinto;

said valve seat (10*f*) is provided at a sideface of said ring groove (10*e*) on the side of said boss (10*d*) base while a stopper portion (10*g*) is provided at a sideface of said ring groove (10*e*) on the side of said boss (10*d*) forward end, said stopper portion (10*g*) coming in contact with said seal member (32) operable to move towards said boss (10*d*) forward end; and a bypass passage is provided for providing the communication of said clearance (40) with said inner compartment (34), with said seal member (32) in contact with said stopper portion (10*g*).

Since, during the reverse operation period, the seal member (32) moves in the direction away from the valve seat (10*f*) to be brought into contact with the stopper portion (10*g*), this makes it possible to control the movement of the seal member (32). If the seal member (32) is in contact with the stopper portion (10*g*), this will interrupt the communication of the clearance (40) defined between the seal member (32) inner, peripheral surface and the boss (10*d*) outer peripheral surface with the inner compartment (34). However, because of the formation of the bypass passage for providing communication between the clearance (40) and the inner compartment (34), the clearance (40) and the inner compartment (34) are allowed to communicate with each other, in other words, the state in which the inner and outer compartments (34) and (35) communicate with each other is maintained. This facilitates the movement control of the seal member (32) during the reverse operation period.

It is possible, as shown in FIGS. 1, 3, and 4, that a slit (32*a*) is formed in a sideface of said seal member (32) on the side of said boss (10*d*) forward end and wherein said bypass passage is provided in said slit (32*a*).

As a result of such arrangement, even when the seal member (32) is brought into contact with the stopper portion (10*g*), the slit (32*a*) will not be brought into the stopper portion (10*g*). This secures passage within the slit (32*a*), thereby placing the clearance (40) between the seal member (32) inner peripheral surface and the boss (10*d*) outer peripheral surface in the state in which the clearance (40) communicates with the inner compartment (34). In other words, such a bypass passage can be provided by merely forming the concave slit (32*a*) in the seal member (32). This easily implements concrete formation of the bypass passage.

It is possible, as shown in FIG. 4, that said notch (10*h*) is formed by cutting a portion of said stopper portion (10*g*) and wherein said bypass passage is provided in said notch (10*h*).

Accordingly, even when the seal member (32) is brought into contact with the stopper portion (10*g*), the clearance (40) and the inner compartment (34) are kept communicating with each other because passage is secured in the notch (10*h*) of the stopper portion (10*g*). The bypass passage can be formed by merely cutting a part of the stopper portion (10*g*). The same effects as the above can be obtained.

It is possible, as shown in FIGS. 6 and 7, that a stopper portion (25*c*) is provided at said concave recess (25*a*) inner peripheral surface of said barrier wall (25), said stopper portion (25*c*) coming in contact with said seal member (32) operable to move towards said boss (10*d*) forward end.

In accordance with this arrangement, in order to control the movement of the seal member (32) during the reverse operation period, the stopper portion (25*c*) is formed at the concave recess (25*a*) of the barrier wall (25). It is sufficient that the boss (10*d*) is provided with the valve seat (10*f*) only. This makes it possible to linearly form an outer peripheral surface portion of the boss (10*d*) located beyond the valve seat (10*f*).

Additionally, when the seal member (32) is in contact with the stopper portion (25*c*), the stopper portion (25) is on the seal member (32) outer peripheral side. This maintains the communication of the clearance (40) between the seal member (32) inner peripheral surface and the boss (10*d*) outer peripheral surface with the inner compartment (34), thereby eliminating the need for forming a bypass passage with a special shape or the like. This provides a further simplified structure for controlling the movement of the seal member (32) during the reverse operation period.

It is possible that:

a concave recess (25*a*) is provided in a surface of said barrier wall (25) on the side of said suction chamber (23), said concave recess (25*a*) having at its bottom wall said discharge opening (25*b*);

a boss (10*d*) is provided on said fixed scroll (10) wherein said boss (10*d*) is play-fitted into said concave recess (25*a*) of said barrier wall (25) in such a way as to define a clearance which partly forms said space (36) and has said discharge port (10*c*); and said valve means (31) includes:

a valve seat which is formed at said concave recess (25*a*) inner peripheral surface; and a seal member;

said seal member being hermetically and slidably fitted into said boss (10*d*) outer periphery of said fixed scroll (10) in order that a clearance, defined between said boss (10*d*) outer peripheral surface and said concave recess (25*a*) inner peripheral surface, may be divided into said inner compartment (34) and said outer compartment (35), with a clearance left between said seal member outer peripheral surface and said concave recess (25*a*) inter peripheral surface;

said seal member being operable to sit on said valve seat when the pressure of said inner compartment (34) exceeds that of said outer compartment (35) thereby interrupting the communication of said inner compartment (34) with said outer compartment (35); and said seal member being operable to move away from said valve seat when the pressure of said outer compartment (35) exceeds that of said inner compartment (34) thereby providing the communication of said inner compartment (34) with said outer compartment (35).

As a result of such arrangement, although the clearance between the seal member outer peripheral surface and the concave recess (25*a*) inter peripheral surface communicates with the inner compartment (34) when the seal member sits on the valve seat during the correct operation period, the communication with the outer compartment (35) is interrupted, in other words, the communication of the inner compartment (34) with the outer compartment (35) is broken. On the other hand, during the reverse operation period, the seal member travels towards the inner compartment (34), i.e., in the direction away from the valve seat. As a result, the clearance comes to communicate with both of the inner compartment (34) and the outer compartment (35), therefore creating the situation in which the compartments (34) and (35) communicate with each other. The same operation effects as the foregoing invention can be obtained.

It is possible that:

a ring groove is provided in said concave recess (25*a*) inner peripheral surface for fitting of said seal member thereinto;

said valve seat is provided at a sideface of said ring groove on said concave recess (25*a*) open side while a stopper portion is provided at a sideface of said ring groove on said concave recess (25*a*) bottom wall side, said stopper portion coming in contact with said seal member operable to move towards said concave recess (25*a*) bottom wall; and a bypass passage is provided for providing the communication of said clearance, defined between said seal member outer peripheral surface and said concave recess (25*a*) inter peripheral surface, with said inner compartment (34), with said seal member in contact with said stopper portion.

As in the foregoing invention, such arrangement makes it possible to control the movement of the seal member when the seal member moves away from the valve seat, by means of the stopper portion. Additionally, because of the bypass passage for providing the communication of the clearance between the seal member outer peripheral surface and the concave recess portion (25*a*) inner peripheral surface and the inner compartment (34), the inner and outer compartments (34) and (35) are kept communicating with each other when the stopper portion is in contact with the seal member. Accordingly, the same operation effects as the foregoing invention can be obtained.

It is possible that a slit is formed in a sideface of said seal member on the side of said concave recess (25*a*) bottom wall and wherein said bypass passage is provided in said slit. This makes it possible to provide a bypass passage for providing communication of the clearance between the seal member outer peripheral surface and the concave recess (25*a*) inner peripheral surface with the inner compartment (34) by merely forming a slit in the seal member.

It is possible that a notch is formed by cutting a portion of said stopper portion and wherein said bypass passage is provided in said notch. This makes it possible to provide a bypass passage by merely cutting a part of the stopper portion. The same operation effects as the foregoing invention can be obtained.

It is possible that a stopper portion is provided at said boss (10*d*) outer peripheral surface of said fixed scroll (10), said stopper portion coming in contact with said seal member operable to move towards said concave recess (25*a*) bottom wall.

Like the foregoing invention, when the seal member is in contact with the stopper portion, the stopper portion is on the seal member (32) inner peripheral side. This maintains the communication of the clearance (40) between the seal member outer peripheral surface and the concave recess (25*a*) inner peripheral surface with the inner compartment (34), thereby eliminating the need for forming a bypass passage or the like. This provides a much further simplified structure for controlling the movement of the seal member during the reverse operation period.

It is possible that:

a boss (10*d*) is provided at a surface of said fixed scroll (10) on the side of said barrier wall (25), said boss (10*d*) having at its bottom wall a concave recess (10*i*) at which said discharge port (10*c*) opens, and said boss (10*d*) protruding with a clearance (50) left between the end surface thereof and said barrier wall (25); and said valve means (31) includes:

a valve seat (25*d*) which is formed around said discharge opening (25*b*) in a surface of said barrier wall (25) on the side of said fixed scroll (10); and a seal member (47) which is hermetically and slidably fitted into a concave recess (10*i*) of said boss (10*d*) in order that said space (36) is divided into said inner compartment (34) and said outer compartment (35);

said seal member (47) being operable to sit on said valve seat (25*d*) when the pressure of said inner compartment (34) exceeds that of said outer compartment (35) thereby interrupting the communication of said inner compartment (34) with said outer compartment (35); and said seal member (47) being operable to move away from said valve seat (25*d*) when the pressure of said outer compartment (35) exceeds that of said inner compartment (34) thereby providing the communication of said inner compartment (34) with said outer compartment (35).

In accordance with this arrangement, the pressure of the inner compartment (34) exceeds that of the outer compartment (35) during the correct operation period. One end surface of the seal member (47) located on the boss bottom wall side, (the inner compartment (34) side) receives a force greater than a force that the other end surface of the seal member (47) located on the clearance (50) side (the outer compartment (35) side) receives. As a result, the seal member (47) moves towards the barrier wall (25) to sit on the valve seat (25*d*). At this time, the communication between the clearance (50) and the inner compartment (34), i.e., the communication between the outer compartment (35) and the inner compartment (34), is broken off.

On the other hand, the pressure of the outer compartment (35) increases to above that of the inner compartment (34) during the reverse operation period. The other end surface of the seal member (47) receives a force greater than a force that the one end surface receives. As a result, the seal member (47) moves towards the boss (10*d*) bottom wall, in other words in the direction away from the valve seat (10*f*). This creates a clearance between the barrier wall (25) and the seal member (47) barrier wall side end surface, such a created clearance providing communication between the clearance (50) and the inner compartment (34). As a result, the inner compartment (34) and the outer compartment (35) communicate with each other. Accordingly, the same operation effects as the foregoing invention can be obtained. In addition, there is no need of providing a concave recess in the barrier wall (25) that fits into the boss (10*d*) of the fixed scroll (10), which makes it possible to form the barrier wall (25) in the form of a plate. This achieves a reduction of the overall compressor cost.

BRIEF DESCRIPTION OF THE DRAWING FIGURES

PREFERRED EMBODIMENTS OF THE INVENTION

Preferred embodiments of the present invention will be described by reference to the accompanying drawings.

Figure 2:
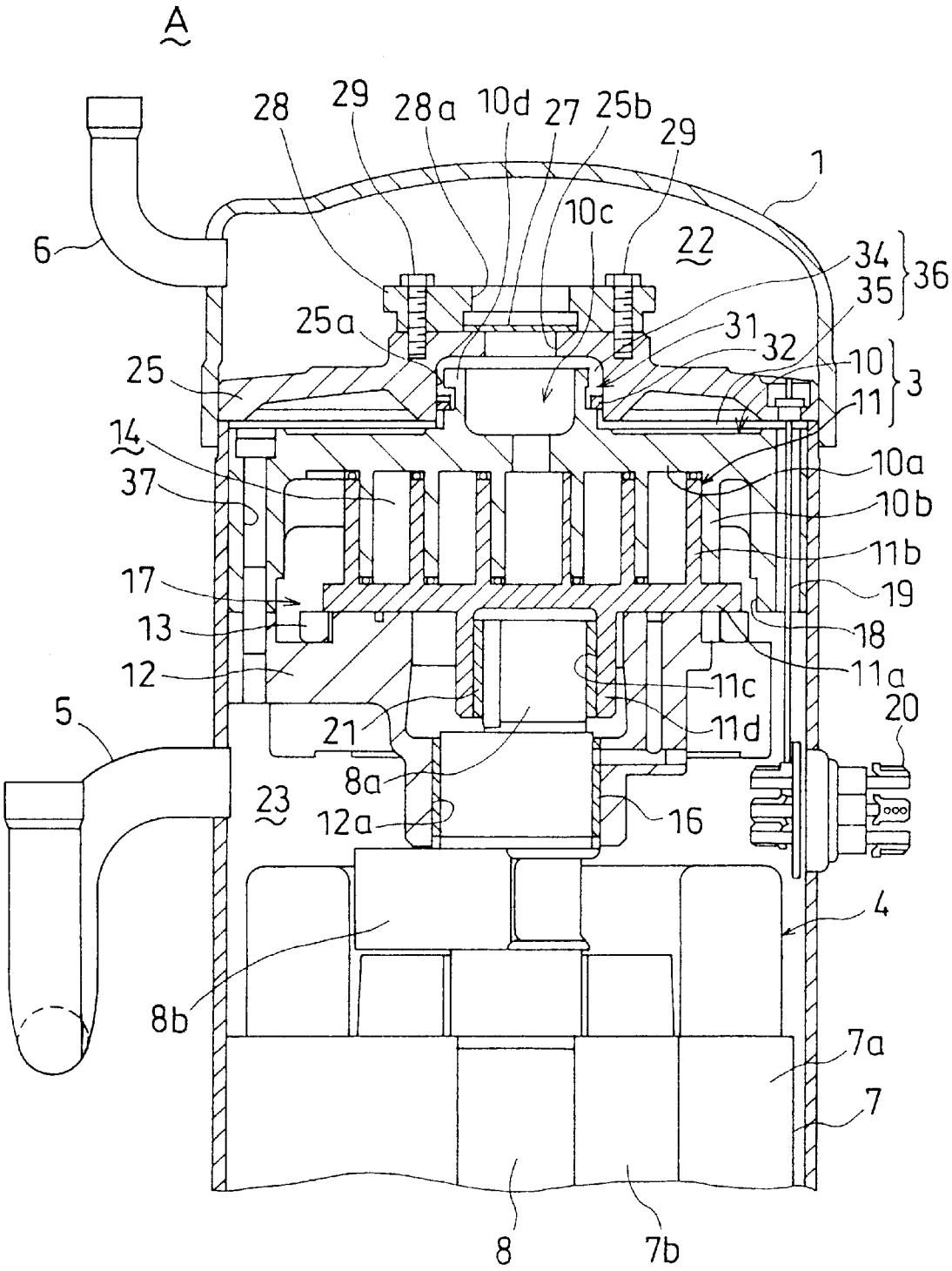
FIG. 2 is a cross-sectional view showing major parts of a scroll compressor formed in accordance with the first embodiment of the present invention.

Referring first to FIG. 2, therein shown is a scroll compressor (A) of this invention. The scroll compressor (A) has a hermetic casing (1). Disposed at the casing (1) upper portion is a barrier wall (25) by which the casing (1) internal cavity is hermetically divided into an upper-side compartment and a lower-side compartment, namely, a discharge chamber (22) and a suction chamber (23). The barrier wall (25) is secured to the casing (1) sidewall upper inner peripheral surface. A scroll compression mechanism (3) is placed in the suction chamber (23) upper portion, with a space (36) left between itself and the barrier wall (25). This scroll compression mechanism (3) is operable to take in gas from the suction chamber (23) for compression and to discharge it. On the other hand, housed in the suction chamber (23) lower portion is a drive mechanism (4) for driving the scroll compression mechanism (3).

Coupled to and passing through the casing (1) sidewall upper portion on the side of the discharge chamber (22), is a discharge line (6). Refrigerant gas, compressed in the scroll compression mechanism (3), is discharged to outside the scroll compressor (A) through the discharge line (6). On the other hand, coupled to and passing through the casing (1) sidewall under the scroll compression mechanism (3) on the side of the suction chamber (23), is a suction line (5) through which refrigerant gas is introduced into the casing (1).

The drive mechanism (4) is made up of an electric motor (7) and a crank shaft (8). The motor (7) has a stator (7*a*) and a rotor (7*b*) which is rotatably disposed in the stator 7*a*. The lower end of the crank shaft (8) is press-fitted into the center of the rotor (7*b*) to be fixed therein, whereby the crank shaft (8) and the rotor (7*b*) rotate together as one body.

The scroll mechanism (3) comprises an upper fixed scroll (10) and a lower moving scroll (11). The fixed scroll (10) has a disk-like panel board (10*a*) and an involute body (10*b*) which projects from a lower surface of the panel board (10*a*). The fixed scroll (10) is secured to the casing (1) sidewall inner peripheral surface with the panel board (10*a*). Approximately centrally formed in the panel board (10*a*) is a discharge port (10*c*) that vertically passes therethrough.

The moving scroll (11) has a disk-like panel board (11*a*). An involute body (11*b*) is formed at the panel board (11*a*) upper surface, protruding therefrom so as to engage with the involute body (10*b*) of the fixed scroll (10). A lower surface of the panel board (11*a*) on the outer peripheral side thereof, is supported on a support housing (12) which is secured to the casing (1) side wall inner peripheral surface through an Oldham's ring (13). The Oldham's ring 13, mounted between the moving scroll (11) and the support housing (12), constitutes an Oldham's coupling (17) for preventing the moving scroll (11) from rotating on its own axis. Additionally, the panel board (11*a*) of the moving scroll (11) has, at its lower surface central portion, a boss (11*d*) protruding therefrom. Formed in the boss (11*d*) lower surface is a coupling recess (11*c*) which recesses upwardly.

A compression chamber (14) for compressing refrigerant gas is formed between the involute body (10*b*) of the fixed scroll (10) and the involute body (11*b*) of the moving scroll (11). Formed on the side of the moving scroll (11) in the periphery of the involute bodies (10*b*) and (11*b*) of the fixed and moving scrolls (10) and (11), is a suction port (18) through which refrigerant gas is drawn into the compression chamber (14).

The portion of the crank shaft (8) above the electric motor (7) is rotatably inserted into a bearing opening (12*a*) formed in the support housing (12) through a bearing (16). Formed integrally with the crank shaft (8) upper end portion is an eccentric cam portion (8*a*) which is not co-axial with the crank shaft (8) axis. The eccentric cam portion (8*a*) is fitted into the coupling recess (11*c*) in the boss (11*d*) of the moving scroll (11) through a bearing (21). Accordingly, because of the provision of the Oldham's coupling (17), the moving scroll (11) is designed not to rotate on its own axis with rotation of the crank shaft (8) but to rotate around the crank shaft (8) thereby reducing the volume of the compression chamber (14). Because of the operation of the scroll compression mechanism (3), refrigerant gas is introduced from the suction chamber (23) into the compression chamber (14) through the suction port (18). The refrigerant gas is compressed in the compression chamber (14), thereafter being carried away to the space (36) between the fixed scroll (10) and the barrier wall (25) by way of the discharge port (10*c*).

Approximately centrally formed in a surface of the barrier wall (25) on the side of the suction chamber (23), i.e., the barrier wall (25) lower surface, is a concave recess (25*a*), and a discharge opening (25*b*) is formed through the bottom wall of the concave recess (25*a*), thereby providing communication between the discharge chamber (22) and the space (36). On the other hand, provided on another surface of the barrier wall (25) on the side of the discharge chamber (22), i.e., the upper surface of the barrier wall (25), is a check valve (27) for opening and closing the discharge opening (25*b*). The check valve (27) is supported around the discharge opening (25*b*) of the barrier wall (25) upper surface in such a manner that it is caught in a valve support member (28) fixed by bolts (29,29) thereto. Approximately centrally formed in the valve support member (28) is a through opening (28*a*) that links with the discharge opening (25*b*), and the check valve (27) is allowed to move vertically between the through opening (28*a*) of the valve support member (28) and the discharge opening (25*b*) of the barrier wall (25). The check valve (27) is operable to allow high-pressure refrigerant gas, compressed in the scroll compression mechanism (3) and discharged through the discharge port (10*c*), to flow from the space (36) of the suction chamber (23) into the discharge chamber (22) through the discharge opening (25*b*) and the through opening (28*a*) of the valve support member (28), while preventing a backflow of gas in the discharge chamber (22) to the suction chamber (23). Stated another way, the check valve (27) moves upwardly by the pressure of high-pressure refrigerant gas discharged from the discharge port (10*c*), thereby placing the discharge opening (25*b*) in the open state. On the other hand, when there is discharged no refrigerant gas from the discharge port (10*c*), the check valve (27) moves downwardly by the pressure of refrigerant gas on the side of the discharge chamber (22), thereby placing the discharge opening (25) in the closed state.

Approximately centrally formed at the fixed scroll (10) upper surface is a boss (10*d*) in the form of a projection. The discharge port (10*c*), which is wider at the top than at the bottom, is formed through the boss (10*d*). The boss (10*d*) is play-fitted into the concave recess (25*a*) of the barrier wall (25) with a gap forming a part of the space (36) left therein.

Figure 1:
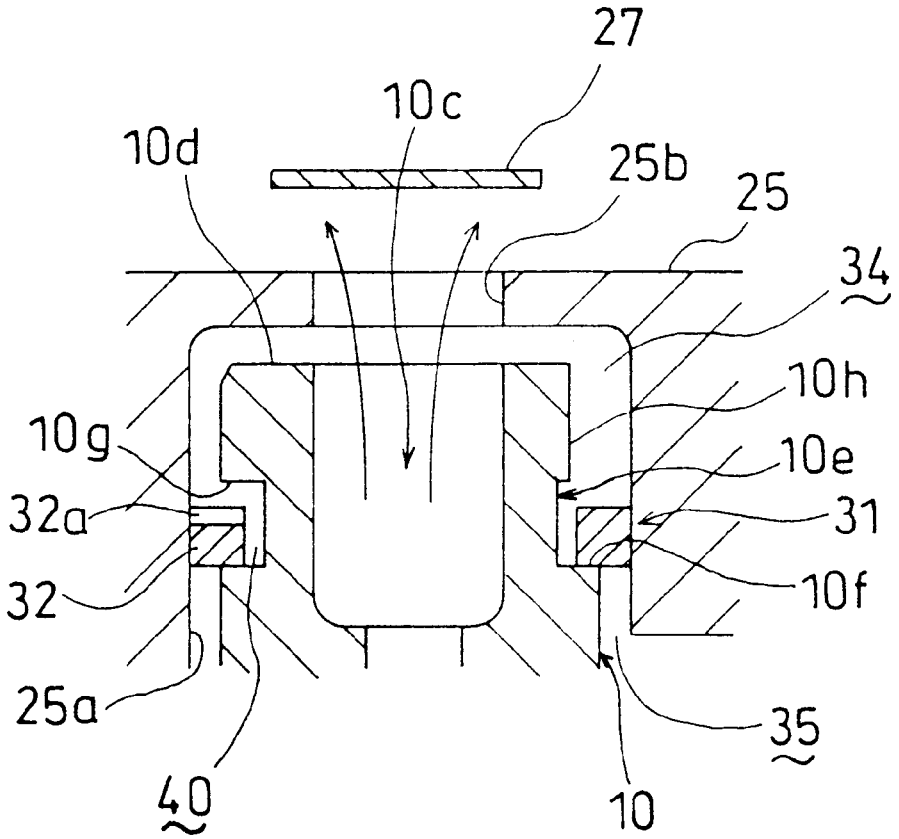
FIG. 1 is a cross-sectional view taken on line I—I of FIG. 4.

As illustrated in FIG. 1, a valve means (31), made up of a seal member (32) and a valve seat (10*f*) on which the seal member (32) sits, is placed in a clearance defined between the boss (10*d*) outer peripheral surface and the concave recess (25*a*) inner peripheral surface in the space (36). In other words, the seal member (32) is hermetically and silidably fitted into the concave recess (25*a*) of the barrier wall (25), with a clearance (40) left between the seal member (32) inner peripheral surface and the boss (10*d*) outer peripheral surface (i.e., a bottom surface of a ring groove (10*e*) formed in the boss (10*d*) outer peripheral surface). The seal member (32) is disposed such that it divides the space (36) defined between the seal member (32), and the boss (10*d*) outer peripheral. surface and the concave recess (25*a*) inner peripheral surface, into the inner compartment (34) in communication with the discharge port (10*c*) side of the fixed scroll (10) in the scroll compression mechanism (3) and the outer compartment (35) on the scroll compression mechanism (3) outer peripheral side. The outer compartment (35) communicates with a space below the scroll compression mechanism (3) through a circulation passage (37) formed through the outer periphery of the fixed scroll (10) and the support housing (12), in other words, the outer compartment (35) is in communication with the suction port (18) located at the outer periphery of the involute bodies (10*b*) and (11*b*).

The valve seat (10*f*) is formed in the boss (10*d*) base outer peripheral surface (i.e., a sideface on the side of the boss (10*d*) base side in the ring groove (10*e*)). When the seal member (32) moves downwardly towards the boss (10*d*) base, it sits on the valve seat (10*f*). During the time when the seal member (32) stays on the valve seat (10*f*) in the ring groove (10*e*), the clearance (40) between the seal member (32) inner peripheral surface and the ring groove (10*e*) bottom surface is in communication with the inner compartment (34), while on the other hand the clearance (40) and the outer compartment (35) are not in communication with each other, in other words the communication of the inner compartment (34) with the outer compartment (35) is being interrupted.

Figure 3:
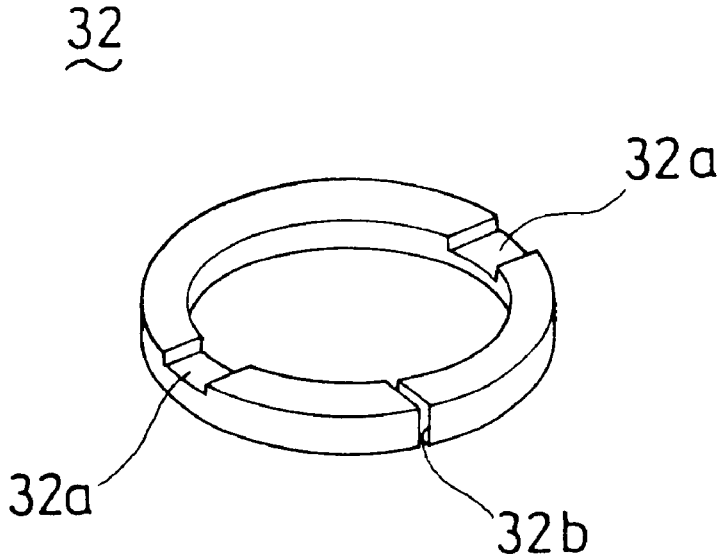
FIG. 3 is a perspective view of a seal member.
Figure 4:
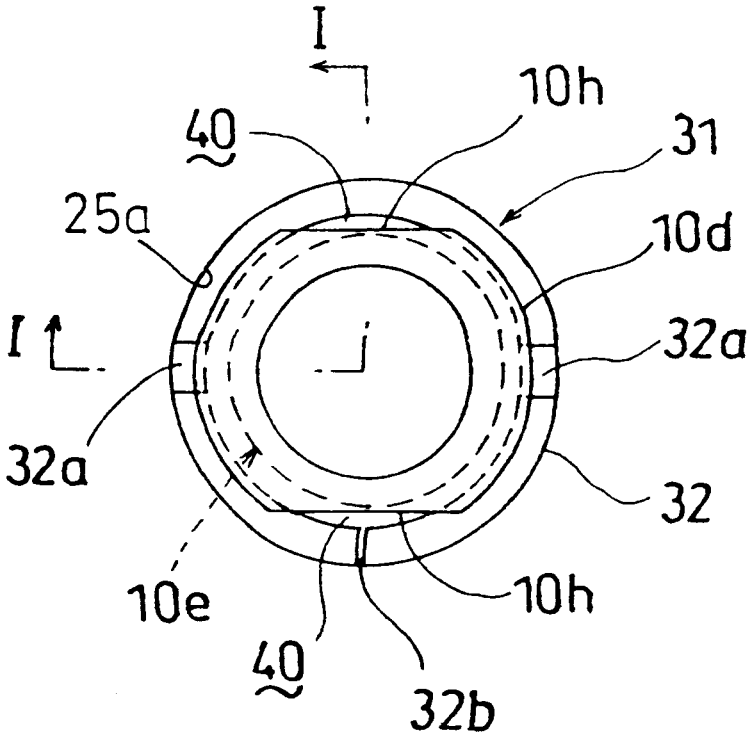
FIG. 4 is a plane view showing major parts of a valve means.

A sideface of the ring groove (10*e*) on the boss (10*d*) forward end side serves as a stopper portion (10*g*) which is brought into contact with the seal member (32) when the seal member (32) moves upwardly away from the valve seat (10*f*) towards the boss (10*d*) forward end. In order to provide communication between the clearance (40) and the inner compartment (34) even when the seal member (32) is brought into contact with the stopper portion (10*g*) in the ring groove (10*e*), a bypass passage is formed. That is, two concave slits (32*a*, 32*a*) are formed in an upper surface of the seal member (32), extending in the direction of the diameter thereof (see FIG. 3). Further, formed in the boss (10*d*) upper outer periphery are notches (10*h*, 10*h*), as shown in FIG. 4. The notches (10*h*, 10*h*) are formed by linear cutting of portions of the boss (10*d*) facing each other in a direction approximately perpendicular to the line connecting the two slits (32*a*, 32*a*) to such an extent that the cutting extends inwardly and radially beyond the seal member (32) inner peripheral surface. The foregoing bypass passage is formed either in the slits (32*a*, 32*a*) or in the notches (10*h*, 10*h*). When the seal member (32) is in contact with the stopper portion (10*g*), the clearance (40) and the inner compartment (34), that is, the outer compartment (35) and the inner compartment (34) communicate with each other through the bypass passage.

If the pressure of the inner compartment (34) exceeds that of the outer compartment (35) during the correct operation period in which the moving scroll (11) in the scroll compression mechanism (3) is operated in the correct rotation direction by the electric motor (7), then the seal member (32) moves downwardly towards the outer compartment (35) to sit onto the valve seat (10*f*) thereby interrupting the communication of the inner compartment (34) with the outer compartment (35). On the other hand, if the pressure of the outer compartment (35) exceeds that of the inner compartment (34) during the reverse operation period in which the moving scroll (11) is operated in the reverse rotation direction, then the seal member (32) separates from the valve seat (10*f*), moves upwardly towards the inner compartment (34), and is brought into contact with the stopper portion (10*g*) thereby providing the communication between the inner compartment (34) and the outer compartment (35) through the bypass passage.

Formed in the seal member (32) is a notch-like abutment (32*b*) for fitting of the seal member (32) into the ring groove (10*e*). In order to separate the abutment (32*b*) ends from each other, the seal member (32) is expanded to increase in its internal diameter. This allows the seal member (32) to be fitted into the ring groove (10*e*) from the boss (10*d*) end. Referring to FIG. 2, reference numeral (19) denotes an oil return passage that is formed through the periphery of the barrier wall (25) and the fixed scroll (10). Lubricating oil at the crank shaft (8) or the like separated from refrigerant gas in the discharge chamber (22) returns to an oil basin at the bottom of the casing (1) by way of the oil return passage (19). Reference numeral (8*b*) is a balance weight. The balance weight (8*b*) is located oppositely relative to the eccentric direction of the eccentric cam (8*a*) and rotates together with the crank shaft (8) as one body. The balance weight (8*b*) serves to offset centrifugal force occurring in the moving scroll (11). Reference numeral (20) is a terminal portion for supplying electric power to the electric motor (7).

The operation of the scroll compressor (A) having the above-described structure is now described below. Electric power is connected to the terminal portion (20) in order that the moving scroll (11) in the scroll compression mechanism (3) may be operated in the correct rotation direction by the electric motor (7). During the correct operation period of the scroll compressor (A), when both the rotor (7*b*) and the crank shaft (8) rotate, as one body, by the electric motor (7), this causes the eccentric cam (8) to revolve around the axis of the crank shaft (8) in the coupling recess (11c) in the boss (11*d*) of the moving scroll (11). With such rotation, the moving scroll (11) rotates around the fixed scroll (10) axis. As a result, the compression chamber (14), defined between the involute body (10*b*) of the fixed scroll (10) and the involute body (11*b*) of the moving scroll (11), shrinks while involutely moving from periphery to center. Because of such a series of operations, low-pressure refrigerant gas within the suction chamber (23) is drawn into the compression chamber (14) through the suction port (18) of the scroll compression mechanism (3) and thereafter is compressed by the shrinkage of the compression chamber (14) to high pressure level. The high-pressure refrigerant gas arrives at the center of the scroll compression mechanism (3). Thereafter, the high-pressure refrigerant gas is discharged from the discharge port (10*c*) into the inner compartment (34) in the space (36) defined between the scroll compression mechanism (3) and the barrier wall (25). Because of the pressure of the high-pressure refrigerant gas, the check valve (27) moves upwardly, whereupon the discharge opening (25*b*) opens. As a result, the discharged gas flows into the discharge chamber (22) by way of the discharge opening (25*b*) and the through hole (28*a*) of the valve support member (28). Thereafter, the gas is discharged to outside the scroll compressor (A) through the discharge line (6).

At this time, the inner compartment (34) is filled with the high-pressure refrigerant gas while on the other hand the outer compartment (35) is filled with refrigerant gas at low pressure from the circulation passage (37) formed in the outer periphery of the fixed scroll (10) and the support housing (12). The inner compartment (34) comes to have a pressure in excess of that of the outer compartment (35), wherein the seal member (32), fitted into the ring groove (10*e*) in the boss (10*d*) of the fixed scroll (10), moves downwardly towards the outer compartment (35) to sit on the valve seat (10*f*) which is a sideface of the ring groove (10*e*) on the side of the boss (10*d*) base. This interrupts the communication of the clearance (40) and the outer compartment (35). Because of such interruption, the high-pressure refrigerant gas in the inner compartment (34) is positively sent to the discharge chamber (22) through the discharge opening (25*b*) of the barrier wall (25) without leakage to the outer compartment (35).

To sum up, with regard to the correct operation period the scroll compressor (A) is almost identical in structure with commonly-used scroll compressors. In addition, the fixed scroll (10) is not provided with anything special. This prevents the deformation of the fixed scroll (10), the loss of heating, and the reexpansion of refrigerant gas. The same operation performance that conventional compressors can provide is maintained in the scroll compressor (A).

Figure 5:
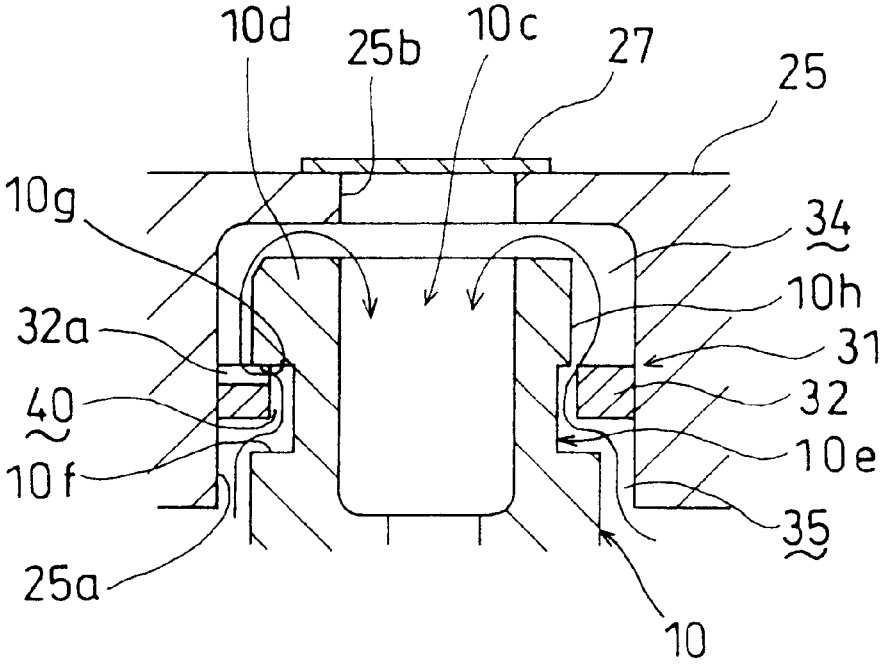
FIG. 5 is an equivalent diagram to FIG. 1 showing the valve means during the reverse operation period in the first embodiment.

On the other hand, if the scroll compressor (A) is opposition operated because the moving scroll (11) is operated in a direction opposite to the correct rotation direction for some reason such as inaccurate power wiring to the terminal portion (20), then the scroll compression mechanism (3) tries to take in refrigerant gas from the discharge port (10*c*) and discharge it at the suction port (18). Because of this, the check valve (27) moves downwardly, wherein the discharge opening (25*b*) of the barrier wall (25) is closed. As a result, the outer compartment (35) comes to have a pressure in excess of that of the inner compartment (34). At this time, if the communication of the inner compartment (34) and the outer compartment (35) remains interrupted by the valve means (31), then there is no flow of refrigerant gas between the inner compartment (34) and the outer compartment (35). In the present embodiment, however, the seal member (32) of the valve means (31) moves upwardly towards the inner compartment (34) (see FIG. 5), as a result of which the seal member (32) is brought into contact with the stopper portion (10*g*) which is a sideface of the ring groove (10*e*) on the boss (10*d*) forward end side. Under this situation, because of the prevision of the bypass passage formed either in each slit (32*a*) of the seal member (32) or in each notch (10*h*) of the boss (10*d*), the clearance (40) and the inner compartment (34) communicate with each other, in other words the inner compartment (34) and the outer compartment (35) communicate with each other. As a result, the refrigerant gas circulates as indicated by arrow of FIG. 5. The refrigerant gas is introduced from the inner compartment (34) into the scroll compression mechanism (3) through the discharge port (10*c*). In the scroll compression mechanism (3), the refrigerant gas flows from the center to the outer periphery thereof, on the contrary to the correct operation period. Thereafter, the refrigerant gas flows from the suction port (18) to a space of the suction chamber (23) under the scroll compression mechanism (3). Finally, the refrigerant gas is brought back to the inner compartment (34), by way of the outer compartment (35) and then the bypass passage formed through the outer periphery of the fixed scroll (10) and the support housing (12). As a result of such arrangement, frictional heat, caused by contact of the forward end surfaces of the involute bodies (10*b*, 11*b*) of the scrolls (10, 11) with their respectively facing panel boards (10*a* 11*a*), is removed to outside of the scroll compression mechanism (3) by such refrigerant gas circulation. In addition, it is designed such that the refrigerant gas circulates throughout the outer periphery of the fixed and moving scrolls (10, 11). Radiation of the frictional heat is performed sufficiently, thereby preventing the forward end surfaces of the involute bodies (10*b*) and (11*b*) from undergoing seizing even when the scroll compressor (A) is opposition operated for a long period of time.

In accordance with the present embodiment, the seal member (32) automatically travels between the valve seat (10*f*) and the stopper portion (10*g*) which are the sidefaces of the ring groove (10*e*) in the boss (10*d*) of the fixed scroll (10) by pressure differential between the inner compartment (34) and the outer compartment (35). As a result of such arrangement, during the correct operation period of the scroll compressor (A), the communication of the inner compartment (34) and the outer compartment (35) is interrupted whilst the communication is established when the scroll compressor (A) is opposition operated. This simplifies the organization of the valve means (31). Accordingly, the present embodiment positively prevents the forward end surfaces of the involute bodies (10*b*) and (11*b*) from undergoing seizing, with a simple organization while maintaining the operation performance of the correct operation period.

Figure 6:
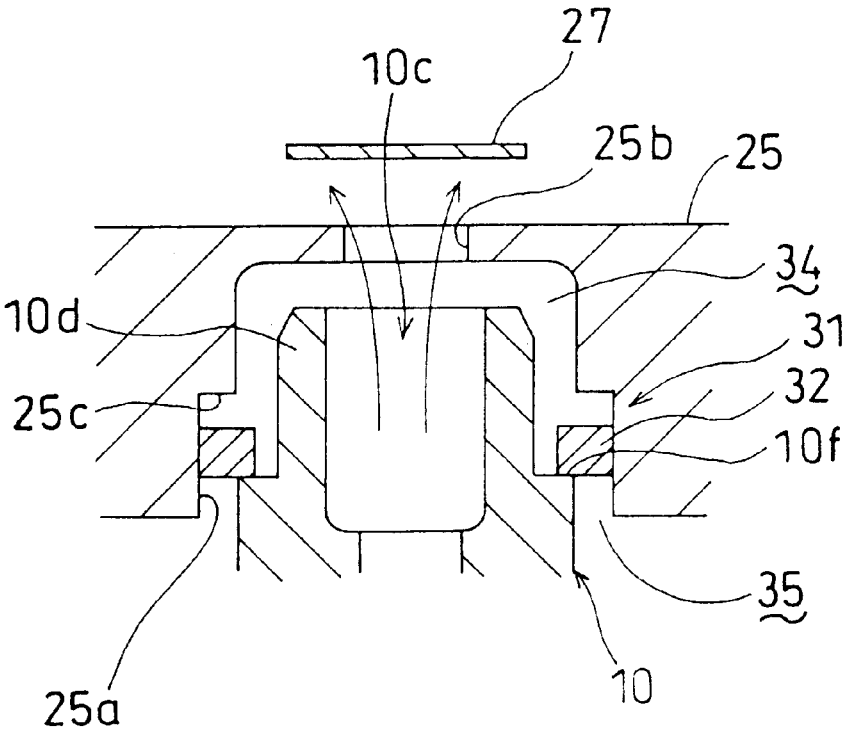
FIG. 6 is an equivalent diagram to FIG. 1 showing the valve means during the correct operation period in the second embodiment.
Figure 7:
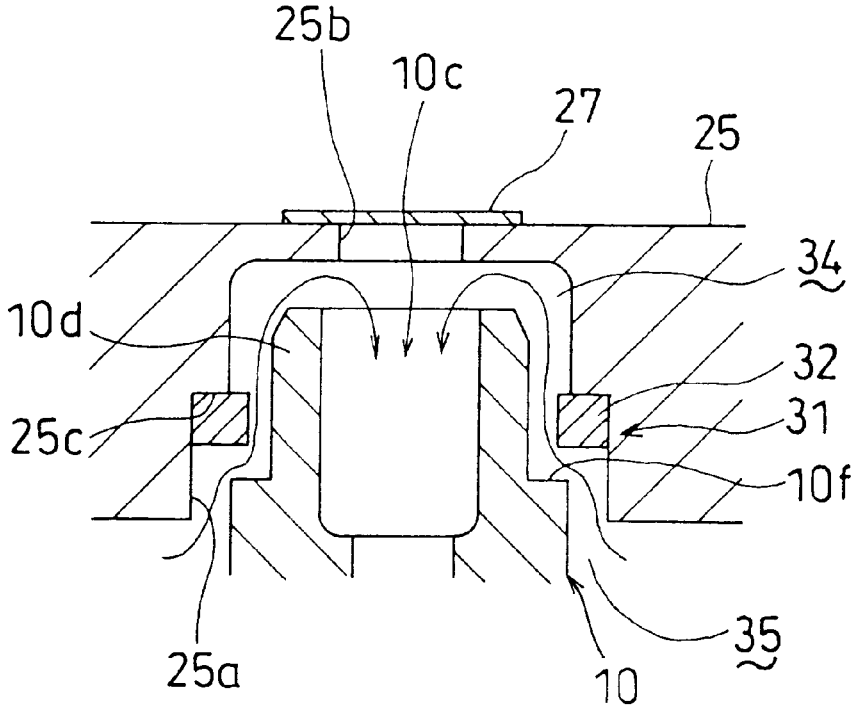
FIG. 7 is an equivalent diagram to FIG. 1 showing the valve means during the reverse operation period in the second embodiment.

Reference is made to FIGS. 6 and 7 to describe a second embodiment of the present invention. The same elements and portions as FIG. 1 have been assigned the same reference numerals and the detailed description thereof is not made. In accordance with the present embodiment, a stopper portion, with which the seal member (32) is brought into contact when moving away from the valve seat (10*f*), is formed in the concave recess (25*a*) inner peripheral surface of the barrier wall (25).

As in the first embodiment, the valve seat (10*f*) is formed at the boss (10*d*) base outer peripheral surface of the fixed scroll (10). A stopper portion (25*c*) is formed at the concave recess (25*a*) inner peripheral surface of the barrier wall (25), at an equivalent level to the stopper portion (10*g*) of the boss (10*d*) of the first embodiment. In addition, the seal member (32) is disposed between the stopper portion (25*c*) and the valve seat (10*f*), with the clearance (40) defined between the seal member (32) inner peripheral surface and the outer peripheral surface on the boss (10*d*) forward end side. Note that neither the slit (32*a*) nor the abutment (32*b*) is formed in the seal member (32) in the present embodiment. The remaining other structures are the same as the first embodiment.

When the scroll compressor (A) is operated in the correct rotation direction, the pressure of the inner compartment (34) comes to exceed that of the outer compartment (35). As a result, the seal member (32) moves downwardly to sit on the valve seat (10*f*), as shown in FIG. 6. This interrupts the communication of the clearance (40) between the boss (10*d*) forward end side outer peripheral surface and the seal member (32) inner peripheral surface with the outer compartment (35).

On the other hand, when the scroll compressor (A) is opposition operated, the outer compartment (35) comes to have a pressure in excess of that of the inner compartment (34). The seal member (32) then travels upwardly to be brought into contact with the stopper portion (25*c*) of the concave recess (25*a*) of the barrier wall (25), as shown in FIG. 7. At this time, since the stopper portion (25*c*) is located on the peripheral side of the seal member (32), this maintains the communication of the clearance (40) and the inner compartment (34). As a result, refrigerant gas flows in the same way as in the first embodiment.

In accordance with the present embodiment, the stopper portion (25*c*), with which the seal member (32) is brought into contact when the seal member (32) separates from the valve seat (10*f*) and moves upwardly, is formed in the concave recess (25*a*) of the barrier wall (25). This eliminates the need for forming a bypass passage for providing communication between the clearance (40) and the inner compartment (34) in situations in which the seal member (32) is in contact with the stopper portion (25*c*). There is no need to provide slits or notches to the seal member (32) and the boss (10*d*). Since the seal member (32) can be fitted into the outer peripheral surface of the boss (10*d*) without providing an abutment to the seal member (32), this eliminates the possibility that refrigerant gas leaks from an open abutment during the correct operation period. This simplifies the structure of the valve means (31) and ensures that the communication of the inner compartment (34) and the outer compartment (35) is positively interrupted.

In accordance with the first and second embodiments, the seal member (32) is fitted into the concave recess (25*a*) of the barrier wall (25) in hermetic manner, with the clearance (40) left between the inner peripheral surface thereof and the boss (10*d*) outer peripheral surface. However, the seal member (32) may be fitted hermetically into the boss (10*d*) outer peripheral surface, with a clearance left between the outer peripheral surface thereof and the concave recess (25*a*) inner peripheral surface. In such a case, the valve seat may be formed at the inner peripheral surface of the concave recess (25*a*) and the stopper portion may be formed either at the inner peripheral surface of the concave recess (25*a*) or at the outer peripheral surface of the boss (10*d*). In cases where a stopper portion is formed at the inner peripheral surface of the concave recess (25*a*), a ring groove, into which the seal member is fitted, is formed in the inner peripheral surface of the concave recess (25*a*). A valve seat is formed at a sideface of the ring groove on the concave recess (25*a*) open side and a stopper portion, into which the seal member operable to move towards the concave recess (25*a*) bottom wall is brought into contact, is formed at a sideface of the ring groove on the concave recess (25*a*) bottom wall side. Slits and notches are formed in the seal member and the concave recess (25*a*), respectively in order to provide communication between a clearance, defined between the seal member outer peripheral surface and the concave recess (25*a*) inner peripheral surface, and the inner compartment (34) when the seal member is in contact with the stopper portion, and a bypass passage is formed within the slits or the notches. This makes it possible to construct the valve means (31) with a simple structure.

Figure 8:
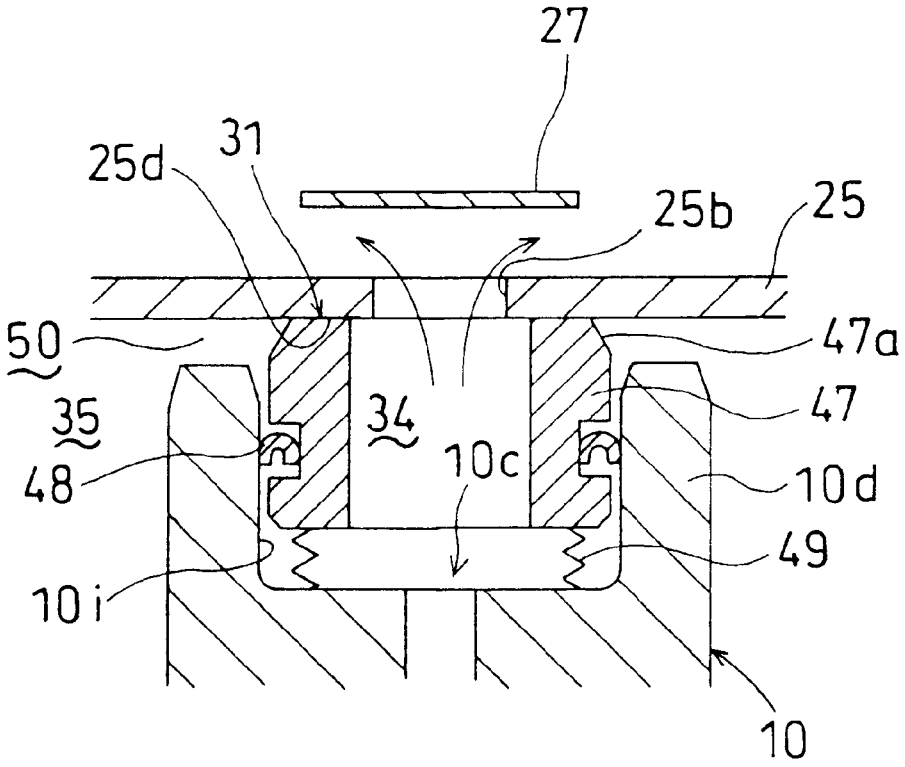
FIG. 8 is an equivalent diagram to FIG. 1 showing the valve means during the correct operation period in the third embodiment.
Figure 9:
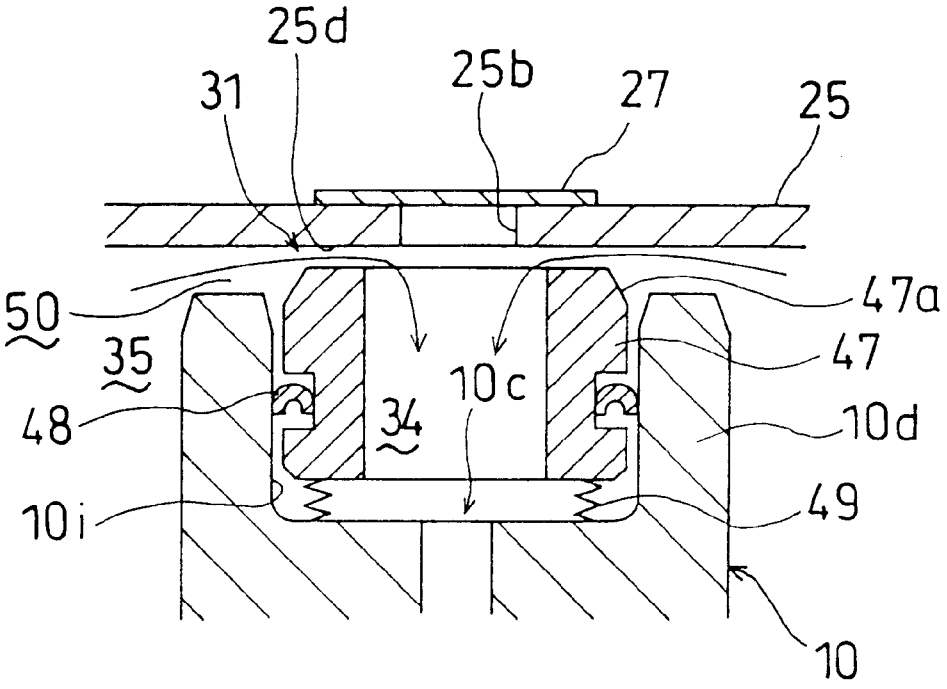
FIG. 9 is an equivalent diagram to FIG. 1 showing the valve means during the reverse operation period in the third embodiment.

Reference is now made to FIGS. 8 and 9 to describe a third embodiment of the present invention. The valve means (31) of the third embodiment has a different structure. Formed at a surface of the fixed scroll (10) on the side of the barrier wall (25) is the projecting boss (10*d*) which has at its bottom wall a concave recess (10*i*) at which the discharge port (10*c*) opens, with a clearance (50) left between the forward end surface thereof and the barrier wall (25). Placed within the concave recess (10*i*) is a hollow cylindrical seal member (47) that divides the space (36) defined between the fixed scroll (10) and the barrier wall (25) into the inner compartment (34) and the outer compartment (35). The outer peripheral surface of the seal member (47) is in hermetic and slidable contact with the inner peripheral surface of the concave recess (10*i*) through a U seal (48).

Formed at a surface of the barrier wall (25) on the side of the fixed scroll (10) around the discharge opening (25*b*) is a valve seat (25*d*). The valve means (31) is made up of the valve seat (25*d*) and the seal member (47). In other words, when the seal member (47) end surface on the boss forward end side (the upper end surface) sits on the valve seat (25*d*) of the barrier wall (25), the communication of the clearance (50) and the inner compartment (34), that is, the communication of the outer compartment (35) and the inner compartment (34) is interrupted. On the other hand, when the seal member (47) separates from the valve seat (25*d*) and moves downwardly, the outer compartment (35) and the inner compartment (34) comes to communicate with each other. The seal member (47) has a lower end surface that is energized upwardly by a spring (49) having a spring force capable of supporting the tare of the seal member (47), and it is arranged such that the seal member (47) sits on the valve seat (25*d*) under normal condition.

The seal member (47) has, at its upper end outer peripheral corner, a taper surface (47*a*) that inclines thereby gradually increasing in diameter. The pressure of the outer compartment (35) is applied to the taper surface (47*a*) through the clearance (50) while the pressure of the inner compartment (34) is applied to the seal member (47) lower surface. When the pressure of the inner compartment (34) exceeds that of the outer compartment (35), the seal member

(47) moves upwardly and then sits on the valve seat (25*d*). On the other hand, when the pressure of the outer compartment (35) exceeds that of the inner compartment (34), the seal member (47) moves downwardly against the energization force of the spring (49) and then separates from the valve seat (25*d*).

In accordance with the above-noted structure, when the scroll compressor (A) is operated normally, the inner compartment (34) comes to have a pressure in excess of that of the outer compartment (35). This causes the seal member (47) to sit on the valve seat (25*d*), therefore interrupting the communication of the inner compartment (34) and the outer compartment (35), as shown in FIG. 8. As a result, high-pressure refrigerant gas, discharged at the discharge port (10*c*) of the fixed scroll (10), flows into the discharge chamber (22) by way of the discharge opening (25*b*) of the barrier wall (25) without leakage to the outer compartment (35).

On the other hand, if the scroll compressor (A) is opposition operated, this causes the outer compartment (35) to have a pressure in excess of that of the inner compartment (34). As a result, the seal member (47) leaves the valve seat (25*d*), as shown in FIG. 9, thereby providing communication of the inner compartment (34) with the outer compartment (35).

In accordance with the present embodiment, the seal member (47) is disposed in the concave recess (10*i*) of the boss (10*d*). This eliminates the need for the formation of a concave recess in the barrier wall (25), which makes it possible to form the barrier wall (25) in the form of a plate, without having to make it by means of die casting. This achieves a further reduction of the overall cost of the scroll compressor (A).

INDUSTRIAL APPLICABILITY OF THE INVENTION

In accordance with the present invention, without a drop in scroll compressor performance during the correct operation period, the radiation of frictional heat produced when the compressor is opposition operated is promoted. Further, seizing taking place in the scroll compressor mechanism can be prevented and the reliability can be improved.

What is claimed is:

1. A scroll compressor comprising:

a barrier wall (25) provided in a casing (1) with an internal cavity portion, said internal cavity portion being divided into a discharge chamber (22) and a suction chamber (23) by said barrier wall, said barrier wall having a discharge opening (25*b*) for providing communication between said discharge chamber (22) and said suction chamber (23);

a check valve (27) for allowing gas to flow from said suction chamber (23) into said discharge chamber (22) through said discharge opening (25*b*) while preventing a reverse flow of said gas from said discharge chamber (22) into said suction chamber (23); and a scroll compression mechanism (3) fixed to said casing (1) and disposed in said suction chamber (23) with a space (36) and extending across a suction chamber side of said barrier wall defined between said scroll compression mechanism (3) and said barrier wall (25), said scroll compression mechanism (3) including (a) a fixed scroll (10) having a panel board (10*a*) from which an involute body (10*b*) projects and (b) a moving scroll (11) having a panel board (11*a*) from which an involute body (11*b*) projects in such a way as to engage with said involute body (10*b*) of said fixed scroll (10), wherein, by virtue of rotation of said moving scroll (11), gas is introduced into a compression chamber (14) between said fixed scroll (10) and said moving scroll (11) from the periphery of both said involute bodies (10*b*, 11*b*) for compression therein and thereafter is discharged to said space (36) through a discharge port (10*c*);

said scroll compressor further comprising:

valve means (31);

said valve means (31) dividing said space (36) into an inner compartment (34) in communication with said discharge port (10*c*) side of said scroll compression mechanism (3) and an outer compartment (35) in communication with each said involute body (10*b*, 11*b*) outer peripheral side;

said valve means (31) being operable to interrupt the communication of said inner compartment (34) with said outer compartment (35) during the correct operation period of said moving scroll (11) in which said moving scroll (11) is operated in a forward rotation direction; and said valve means (31) being operable to provide the communication of said inner compartment (34) with said outer compartment (35) during the reverse operation period of said moving scroll (11) in which said moving scroll (11) is operated in the reverse rotation direction.

2. The scroll compressor of claim 1, wherein:

a concave recess (25*a*) is provided in a surface of said barrier wall (25) on the side of said suction chamber (23), said concave recess (25*a*) having at its bottom wall said discharge opening (25*b*);

a boss (10*d*) is provided on said fixed scroll (10) wherein said boss (10*d*) is play-fitted into said concave recess (25*a*) of said barrier wall (25) in such a way as to define a clearance which partly forms said space (36) and has said discharge port (10*c*); and said valve means (31) includes:

a valve seat (10*f*) formed at said boss (10*d*) outer peripheral surface; and a seal member (32);

said seal member (32) being hermetically and slidably fitted into said concave recess (25*a*) of said barrier wall (25) in order that a clearance, defined between said boss (10*d*) outer peripheral surface and said concave recess (25*a*) inner peripheral surface, is divided into said inner compartment (34) and said outer compartment (35), with a clearance (40) left between said seal member (32) inner peripheral surface and said boss (10*d*) outer peripheral surface;

said seal member (32) being operable to sit on said valve seat (10*f*) when the pressure of said inner compartment (34) exceeds that of said outer compartment (35) thereby interrupting the communication of said inner compartment (34) with said outer compartment (35); and said seal member (32) being operable to move away from said valve seat (10*f*) when the pressure of said outer compartment (35) exceeds that of said inner compartment (34) thereby providing the communication of said inner compartment (34) with said outer compartment (35).

3. The scroll compressor of claim 2, wherein:

a ring groove (10*e*) is provided in said boss (10*d*) outer peripheral surface of said fixed scroll (10) for external fitting of said seal member (32) thereinto;

said valve seat (10*f*) is provided at a sideface of said ring groove (10*e*) on the side of said boss (10*d*) base while a stopper portion (10*g*) is provided at a sideface of said ring groove (10*e*) on the side of said boss (10*d*) forward end, said stopper portion (10*g*) coming in contact with said seal member (32) operable to move towards said boss (10*d*) forward end; and a bypass passage is provided for providing the communication of said clearance (40) left between said seal member (32) inner peripheral surface and said boss (10*d*) with said inner compartment (34), with said seal member (32) in contact with said stopper portion (10*g*).

4. The scroll compressor of claim 3, wherein a slit (32*a*) is formed in a sideface of said seal member (32) on the side of said boss (10*d*) forward end and wherein said bypass passage is provided in said slit (32*a*).

5. The scroll compressor of claim 3, wherein a notch (10*h*) is formed by cutting a portion of said stopper portion (10*g*) at said ring groove (10*e*) on the side of said boss (10*d*) and wherein said bypass passage is provided in said notch (10*h*).

6. The scroll compressor of claim 2, wherein a stopper portion (25*c*) is provided at said concave recess (25*a*) inner peripheral surface of said barrier wall (25), said stopper portion (25*c*) coming in contact with said seal member (32) operable to move towards said boss (10*d*) forward end.

7. The scroll compressor of claim 1, wherein:

a concave recess (25*a*) is provided in a surface of said barrier wall (25) on the side of said suction chamber (23), said concave recess (25*a*) having at its bottom wall said discharge opening (25*b*);

a boss (10*d*) is provided on said fixed scroll (10) wherein said boss (10*d*) is play-fitted into said concave recess (25*a*) of said barrier wall (25) in such a way as to define a clearance which partly forms said space (36) and has said discharge port (10*c*); and said valve means (31) includes:

a valve seat which is formed at said concave recess (25*a*) inner peripheral surface; and a seal member;

said seal member being hermetically and slidably fitted into said boss (10*d*) outer periphery of said fixed scroll (10) in order that a clearance, defined between said boss (10*d*) outer peripheral surface and said concave recess (25*a*) inner peripheral surface, being divided into said inner compartment (34) and said outer compartment (35), with a clearance left between said seal member outer peripheral surface and said concave recess (25*a*) inter peripheral surface;

said seal member being operable to sit on said valve seat when the pressure of said inner compartment (34) exceeds that of said outer compartment (35) thereby interrupting the communication of said inner compartment (34) with said outer compartment (35); and said seal member being operable to move away from said valve seat when the pressure of said outer compartment (35) exceeds that of said inner compartment (34) thereby providing the communication of said inner compartment (34) with said outer compartment (35).

8. The scroll compressor of claim 7, wherein:

a ring groove is provided in said concave recess (25*a*) inner peripheral surface for fitting of said seal member thereinto;

said valve seat is provided at a sideface of said ring groove on said concave recess (25*a*) open side while a stopper portion is provided at a sideface of said ring groove on said concave recess (25*a*) bottom wall side, said stopper portion coming in contact with said seal member operable to move towards said concave recess (25*a*) bottom wall; and a bypass passage is provided for providing the communication of said clearance, defined between said seal member outer peripheral surface and said concave recess (25*a*) inter peripheral surface, with said inner compartment (34), with said seal member in contact with said stopper portion.

9. The scroll compressor of claim 8, wherein a slit is formed in a sideface of said seal member on the side of said concave recess (25*a*) bottom wall and wherein said bypass passage is provided in said slit.

10. The scroll compressor of claim 8, wherein a notch is formed by cutting a portion of said stopper portion at said ring groove on the side of said concave recess bottom wall and wherein said bypass passage is provided in said notch.

11. The scroll compressor of claim 7, wherein a stopper portion is provided at said boss (10*d*) outer peripheral surface of said fixed scroll (10), said stopper portion coming in contact with said seal member operable to move towards said concave recess (25*a*) bottom wall.

12. The scroll compressor of claim 1, wherein:

a boss (10*d*) is provided at a surface of said fixed scroll (10) on the side of said barrier wall (25), said boss (10*d*) having at its bottom wall a concave recess (10*i*) at which said discharge port (10*c*) opens, and said boss (10*d*) protruding with a clearance (50) left between the end surface thereof and said barrier wall (25); and said valve means (31) includes:

a valve seat (25*d*) which is formed around said discharge opening (25*b*) in a surface of said barrier wall (25) on the side of said fixed scroll (10); and a seal member (47) which is hermetically and slidably fitted into a concave recess (10*i*) of said boss (10*d*) in order that said space (36) defined between said scroll compression mechanism (3) and said barrier wall (25) is divided into said inner compartment (34) and said outer compartment (35);

said seal member (47) being operable to sit on said valve seat (25*d*) when the pressure of said inner compartment (34) exceeds that of said outer compartment (35) thereby interrupting the communication of said inner compartment (34) with said outer compartment (35); and said seal member (47) being operable to move away from said valve seat (25*d*) when the pressure of said outer compartment (35) exceeds that of said inner compartment (34) thereby providing the communication of said inner compartment (34) with said outer compartment (35).

* * * * *

UNITED STATES PATENT AND TRADEMARK OFFICE

CERTIFICATE OF CORRECTION

PATENT NO. : 6,095,764
DATED : August 1, 2000
INVENTOR(S) : Yoshitaka Shibamoto et al.

It is certified that error appears in the above-identified patent and that said Letters Patent is hereby corrected as shown below:

Title page,
Item [57], ABSTRACT,
Line 9, change "which" to -- with --.

Signed and Sealed this

Thirteenth Day of May, 2003

JAMES E. ROGAN
*Director of the United States Patent and Trademark Office*